United States Patent [19]

Tsou

[11] Patent Number: 4,688,334

[45] Date of Patent: Aug. 25, 1987

[54] APPARATUS FOR MAKING PERSPECTIVE DRAWINGS

[75] Inventor: Yeong-Haw Tsou, Alhambra, Calif.

[73] Assignee: CC&T Product Development Co., Inc., Alhambra, Calif.

[21] Appl. No.: 865,140

[22] Filed: May 20, 1986

[51] Int. Cl.[4] ..... B43L 13/02

[52] U.S. Cl. ..... 33/444; 33/1 K; 33/449

[58] Field of Search ..... 33/444, 1 K, 18.3, 432, 33/449

[56] References Cited

U.S. PATENT DOCUMENTS

| | | | |
|---|---|---|---|
| 1,343,600 | 6/1920 | West | 33/444 |
| 2,488,284 | 11/1949 | Froelich | 33/444 |
| 3,225,445 | 12/1965 | Duggan | 33/449 |
| 3,258,843 | 7/1966 | Nosser | 33/432 |
| 3,389,470 | 6/1968 | Johnson | 33/432 |
| 3,718,975 | 3/1973 | Ross | 33/432 |
| 4,075,762 | 2/1978 | Ohtake | 33/432 |
| 4,339,881 | 7/1982 | Kapp | 33/444 |
| 4,453,318 | 6/1984 | Hayes | 33/432 |

*Primary Examiner*—Willis Little

*Attorney, Agent, or Firm*—Sheldon & Mak

[57] ABSTRACT

Perspective drawing apparatus comprises a straightedge assembly having a blade for guiding a tool and at least one flexible member on a tensioned spool, a free end of the flexible member being connected to an anchor device for location at a vanishing point. The assembly is provided with reference points for determining when the blade is aligned with a ray portion of the flexible member intersecting the vanishing point. Preferably at least two of the flexible members are provided for selectively referencing a plurality of vanishing points of the drawing. The apparatus includes an anchor device incorporating an adjustable arm for locating the vanishing point within or without the drawing surface, the arm being selectively located along an edge of the drawing surface by a clamp having a threaded member conveniently located above the drawing surface. The clamp includes a movable spacer member for accommodating variant thickness of the drawing surface.

24 Claims, 12 Drawing Figures

APPARATUS FOR MAKING PERSPECTIVE DRAWINGS

BACKGROUND

The present invention relates to drawing instruments and more particularly to a device and accessories thereto for facilitating the making of perspective drawings.

In perspective drawing, a plurality of straight line segments are drawn toward one or more vanishing points. A conventional method for drawing line segments toward a vanishing point is to locate a pin at the vanishing point and hold a ruler or guide against the pin while guiding a drawing device along the bar. A prior art improvement of this method is to provide a locating slot or hole in the bar for keeping the bar engaged with the pin.

In order to permit the vanishing point to be located between the reach of the bar, and to avoid a requirement for a long, clumsy guide bar, some drawing instruments of the prior art incorporate a mechanism for pivoting one or more bars about corresponding remotely located points as the bars are moved about on the drawing surface.

Many of the devices for producing perspective drawings in the prior art exhibit at least some of the following disadvantages:

1. They are ineffective in that they are limited to certain viewing angles and small drawing sizes;
2. They are not portable in that they require a custom-built drawing table;
3. They are inaccurate in that they do not maintain a selected vanishing point;
4. They have limited use in that they are not suitable for drawing parallel lines;
5. They are expensive to produce in that they incorporate elaborate mechanisms requiring tight manufacturing tolerances;
6. They are hard to use in that they require a complicated mechanism adjustment;
7. They are cumbersome in that they obstruct the drawing surface; and
8. They are unwieldy in that they require rigid movable members extending to distant vanishing points.

Thus there is a need for perspective drawing instrument that is effective, portable, accurate, versatile, inexpensive to produce, and easy to use.

SUMMARY

The present invention is directed to perspective drawing apparatus that meets this need by referencing a conveniently sized straightedge to a distant vanishing point by means of an extensible flexible cord. The apparatus comprises a straightedge base, a flexible member extensible therefrom, anchor means for attaching the flexible member at a selected vanishing point, tensioning means for pulling the flexible member on a straight radial line from the vanishing point, and alignment means for aligning the straightedge with the radial line.

Preferably the tensioning means includes storage means for receiving a first end of the flexible member on the straightedge, and biasing means for pulling the flexible member into the storage means. Preferably the storage means is a rotatably mounted spool on which the flexible member is wound, the biasing means being a spring for turning the spool. Preferably the spring protrudes the spool, providing an attachment for the flexible member.

Preferably the anchor means comprises swivel means on a second end of the flexible member. In one version, the anchor means includes a sharpened pin member for penetrating the drawing surface in line with the swivel means.

In another version, the anchor means includes a plate member for taping to the drawing surface, the plate member having target indicia for locating the swivel means in line with the intersection of a pair of lines designating the vanishing point.

In a further version, the anchor means includes arm means having means for clamping to the drawing surface, a pivotably mounted arm member, means for locking the arm member in fixed angular relation to the clamp means, and means for mounting the swivel means on the arm member proximate the plane of the drawing surface. Preferably the clamp means includes a frame member for locating at an edge of a table member that includes the drawing surface; a shoe member threaded to a nut member on the frame member; and a spacer member for compensating variant thicknesses of the table member, the spacer member engaging the frame member in one of at least two positions corresponding to the variant thicknesses, the spacer member bearing against the table member opposite the drawing surface.

Preferably, the means for aligning includes a primary upwardly extending reference member at an end of the straightedge, and a secondary reference member displaced from the end of the straightedge, a reference portion of the flexible member being formed between the reference members when the flexible member contacts the primary reference member. Accordingly, the alignment is obtained by holding the straightedge at a desired point on the drawing surface, then rotating the straightedge in the plane of the drawing until the flexible member just comes into contact with the primary reference member. Thus positioned, the straightedge provides guidance for a desired line segment of the drawing, the line segment being oriented in a direction intersecting the vanishing point.

Preferably, the straightedge is equipped with two of the flexible members, each having associated anchoring, tensioning, and alignment means. Thus the straightedge can be selectively aligned to either of two vanishing points by a quick rotational movement.

Preferably, the straightedge includes a movable reference member for use when it is desired to draw parallel lines. In normal use, as described above, the movable reference member is positioned at or above the drawing plane. For drawing parallel lines, the reference member is locked in a lowered position perpendicular to the drawing plane and square with the straightedge. The reference member is then used for guiding the straightedge perpendicular to an edge of the table member. Thus the present invention provides in a single instrument means for drawing conventional drawings having no parallel lines, and perspective drawings having some parallel lines.

The present invention also provides a method for producing a perspective drawing on a planar drawing surface, including the steps of:

(a) locating first anchor means at the first vanishing point;

(b) connecting a first flexible member at a first end thereof to the first anchor means;

(c) connecting a second end of the first flexible member to a first tensioning spool, the first tensioning spool being mounted to a straightedge, the first flexible member forming a first ray portion radiating on a straight line from the first vanishing point, (d) positioning the straightedge on the drawing surface so that the first ray portion points along a selected one of the line elements; and (e) aligning the straightedge with the first ray portion of the first flexible member.

Preferably the method is capable of producing a drawing also having a second vanishing point, the method further including the steps of:

(a) locating second anchor means at the second vanishing point;

(b) connecting a second flexible member at a first end thereof to the second anchor means;

(c) connecting a second end of the second flexible member to a second tensioning spool, the second tensioning spool being mounted to a straightedge, the second flexible member forming a second ray portion radiating on a straight line from the second vanishing point;

(d) positioning the straightedge on the drawing surface so that the second ray portion points along a selected one of the line elements; and (e) aligning the straightedge with the second ray portion of the second flexible member.

DRAWINGS

These and other features, aspects, and advantages of the present invention will become better understood with reference to the following description, appended claims, and accompanying drawings where:

FIG. 7 is an exploded oblique perspective view showing an alternate configuration of FIG. 6;

DESCRIPTION

Figures 1, 2, 4:
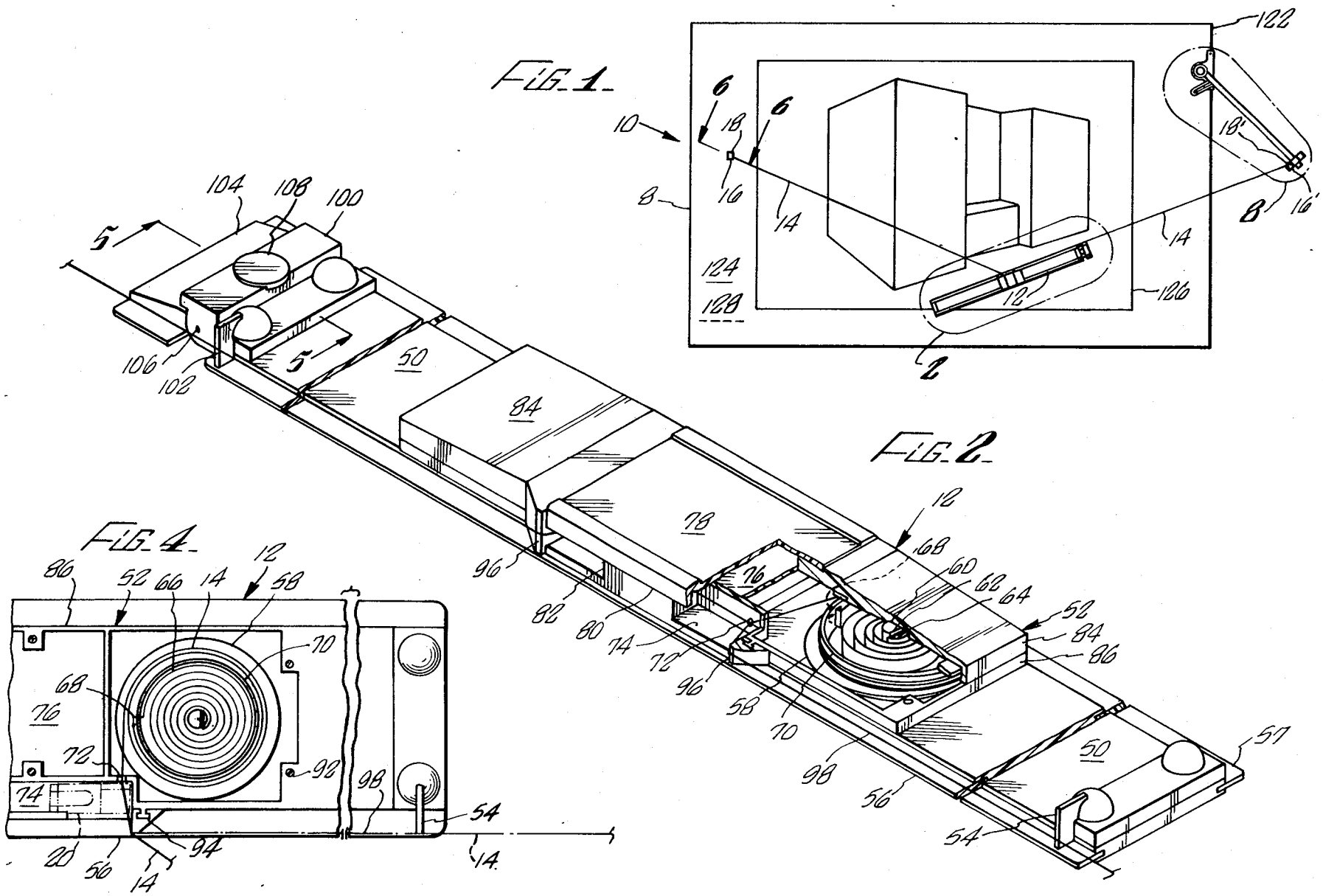
FIG. 1 is a plan view of apparatus for making perspective drawings according to the present invention.
FIG. 2 is an oblique perspective view of the apparatus of FIG. 1 within region 2 of FIG. 1.
FIG. 4 is a fragmentary sectional plan view of the instrument of FIG. 1 taken on line 4—4 in FIG. 2.
Figures 1, 3, 5, 6:
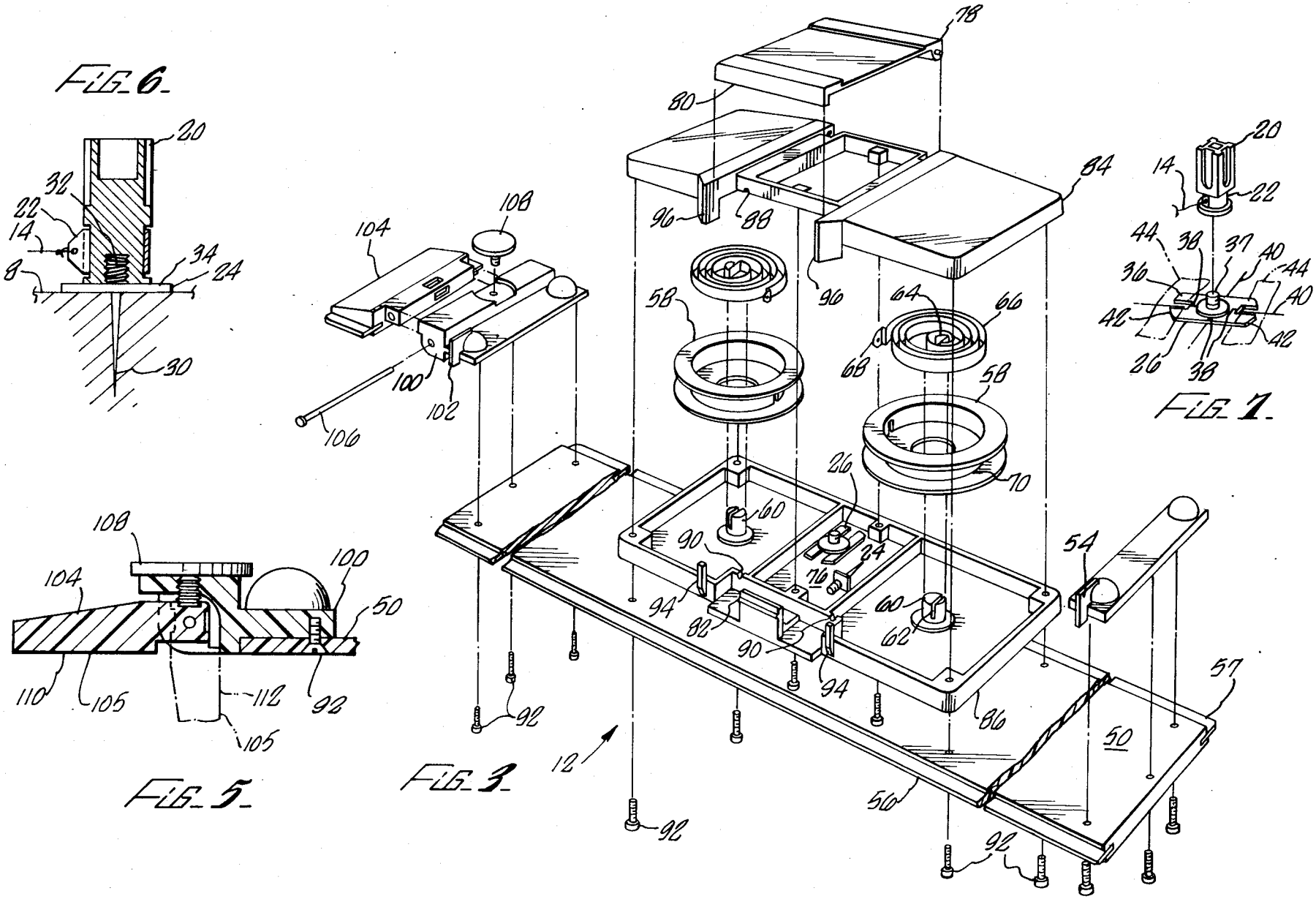
FIG. 3 is an exploded perspective view of the apparatus of FIG. 1 within region 2 of FIG. 1.
FIG. 5 is a fragmentary sectional elevational view of of FIG. 1 taken on line 5—5 in FIG. 2.
FIG. 6 is a sectional elevational view of the apparatus of FIG. 1 along line 6—6 in FIG. 1.
Figure 11:
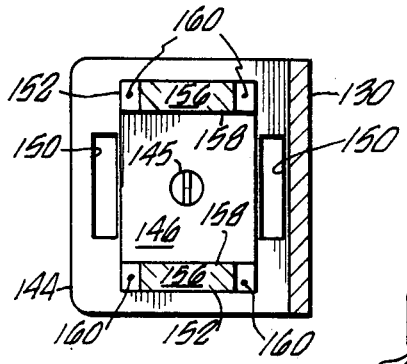
FIG. 11 is a sectional elevational view of the apparatus of FIG. 8 along line 11—11 of FIG. 10.
Figure 8:
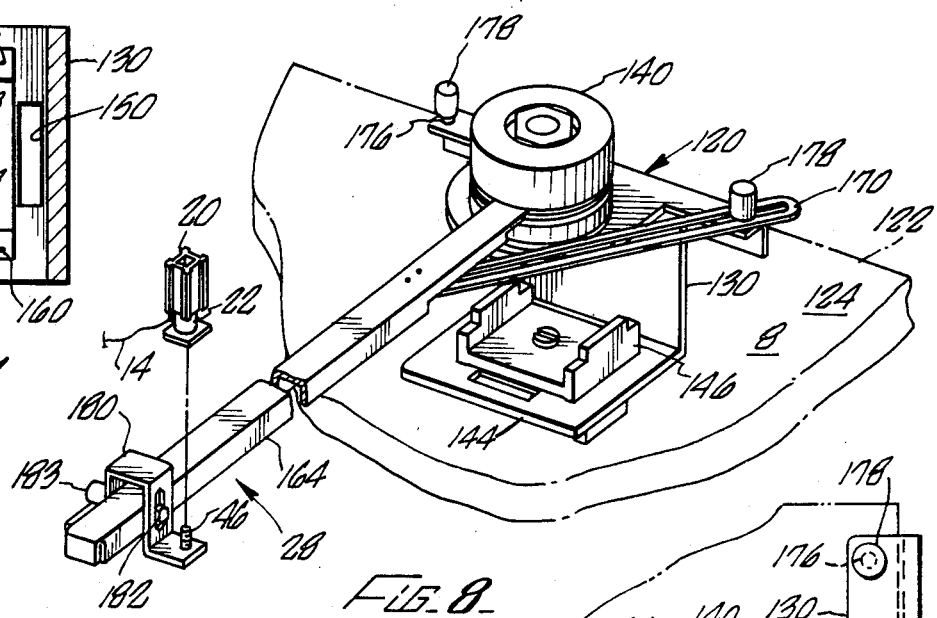
FIG. 8 is an oblique perspective view of the apparatus of FIG. 1 within region 8 of FIG. 1.
Figure 9:
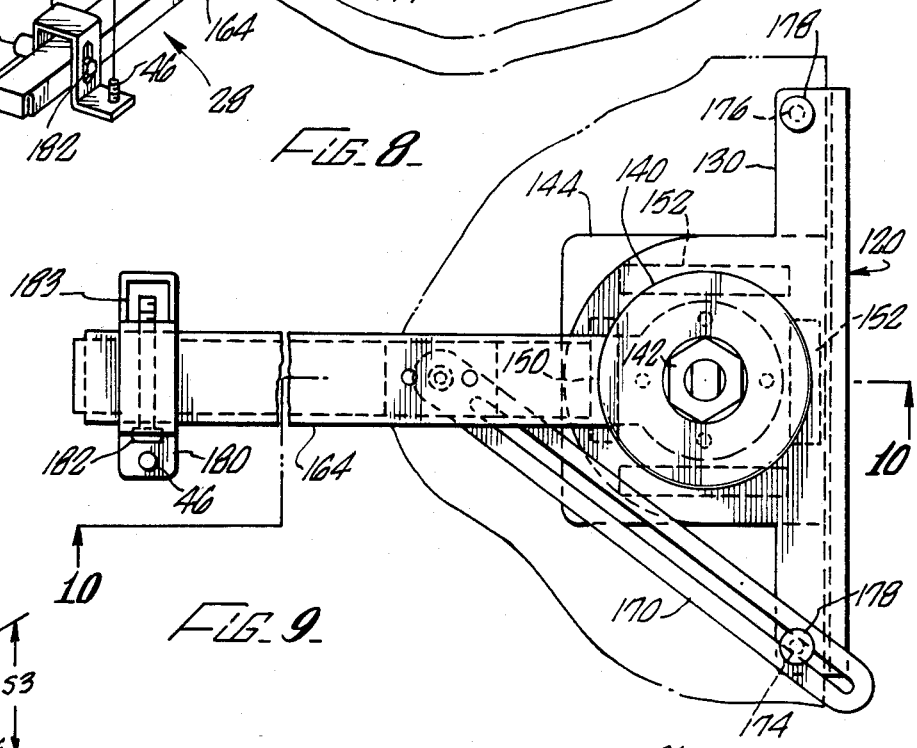
FIG. 9 is a plan view showing the apparatus of FIG. 8.
Figure 12:
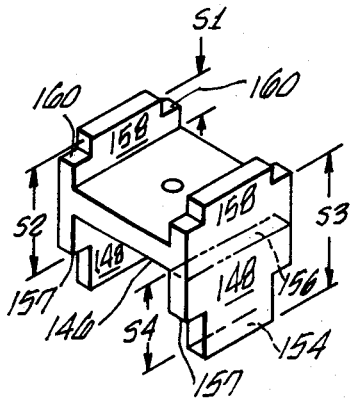
FIG. 12 is oblique perspective detail view of the apparatus of FIG. 8 in region 12 of FIG. 10.

The present invention is directed to a method and apparatus for preparing perspective drawings. With reference to FIGS. 1–7, a table manner 8 supports instrument apparatus 10 according to the present invention. A straightedge assembly 12 of the apparatus 10, movably resting on the table member 8, is connected by at least one retractile cord 14 to anchor means 16, the anchor means 16 being located at a desired vanishing point 18. As shown in FIG. 1, there are two anchor means 16 and 16′ for corresponding vanishing points 18 and 18′.

The anchor means 16 includes a cap 20 and an anchor band 22 for connection with the cord 14. The band 22 is rotatably mounted to the cap 20 for permitting movement of the straightedge assembly with respect to the anchor means 16 while permitting the cord 14 to remain in radial alignment with the vanishing point 18. The cap 20 is threaded for selective engagement with an anchor pin 24, an anchor plate 26, and an arm assembly 28, the cap 20 being fixed in a selected location with respect to the table member 8 as described herein. As shown in in FIG. 6, the anchor pin 24 includes a pin member 30 for penetrating the table member 8, and a threaded post 32 for engaging the cap 20. The pin member 30 and the post 32 coaxially extend from opposite sides of a rectangular head member 34 so that the anchor band swivels on an axis intersecting the vanishing point 18 when the pin member 30 is located at the vanishing point 18. The rectangular shape of the head member 34 facilitates assembly and disassembly of the cap 20 and the anchor pin 24.

When it is desired or necessary to avoid penetration of the table member 8 by the pin member 30, the cap 20 is instead engaged with the anchor plate 26 as shown in FIG. 7. The anchor plate 26 includes a plate member 36 for attachment to the table member, the plate member 36 having a threaded post member 37 affixed thereto and extending upwardly therefrom for engagement by the cap 20 as described above. The plate member 36 is marked with a pattern of target lines 38 for locating the post member 37 directly over the vanishing point 18 as defined by a pair of orthogonally intersecting centerlines 40. The plate member 36 includes a plurality of outwardly extending tabs 42 for engagement by strips of adhesive tape 44, the tape 44 holding the anchor plate 26 in place on the table member 8. The outwardly extending tabs 42 add stability to the anchor plate 26 and facilitate use of the tape 44 without covering the target lines 38. When it is desired to use neither the anchor pin 24 nor the anchor plate 26, or when the vanishing point 18 is located outside of the table member 8, as at 18′ in FIG. 1, the cap 20 is attached to a threaded post 46 of the arm assembly 28, further described below.

The straightedge assembly 12 includes a base 50 having a housing 52 and at least one primary reference member 54 affixed thereto. The housing 52 receives the cord 14 as described herein. The base 50 is formed as an elongated strip member having a blade member 56 affixed along one side thereof for guiding a drawing instrument (not shown). The blade member 56 is preferably transparent for facilitating placement of the straightedge assembly 12 in a desired location on the table member 8. The reference member 54 extends upwardly from proximate one end of the blade member 56 for contacting the cord 14 and locating the outward extremity of blade member 56 directly under the portion of the cord 14 in contact with the reference member 54. As shown in the drawings, an additional blade member, designated blade member 57, is affixed opposite the blade member 56, the blade member 57 being metallic for guiding a cutting instrument (not shown).

At least one spool 58 is rotatably mounted in the housing 52 on a boss 60, the boss 60 having a slot 62 for engaging a fixed end 64 of a spiral spring 66. An opposite end 68 of the spring 66 to protrudes a drum member 70 of the spool 58, the cord 14 being attached to the end 68 of the spring 66, a portion of the cord 14 being wound on the drum member 70 of the spool 58. When the cap 20 is moved away from the housing 52, the cord 14 is withdrawn from the housing 52, and the spool 58 rotates on the boss 60 as the cord 14 unwinds from the drum member 70 and the spring 66 is simultaneously wound up. Accordingly, when the cap 20 is moved toward the housing 52, the cord 14 is pulled into the housing 52, being wound onto the drum member 70 as the spool 58 is rotated by the spring 68. Thus the spring 66 maintains the flexible member 14 in tension between the spool 58 and the cap 20.

The cord 14 enters the housing 52 at an entrance 72 from within a cavity 74 therein, the cavity 74 receiving the cap 20 when the cord 14 is not in use. The cap 20 is retained in the cavity 74 by the tension of the cord 14. The housing 52 also includes a container portion 76 for storing one or more of the anchor pins 24 and the anchorplates 26, the container portion 76 having a hinged lid 78 for enclosing the container portion 76. The lid 78 includes a handle portion 80 for releasably engaging a latch plate 82 of the housing 52. The latch plate 82 forms an upwardly extending portion of the cavity 74, the latch plate 82 and the lid 78 contributing to the retention of the cap 20 in the cavity 74. Thus access to the cavity 74 is enhanced when the lid 78 is open.

The entrance 72 is formed as a facing pair of slots between mating upper and lower housing members, designated upper member 84 and lower member 86, the slots being designated upper slot 88 and lower slot 90. The lower member 86 is clamped between the upper member 84 and the base 50 by a plurality of screws 92. A pair of interlock members 94, extending from the lower member 86, engages the upper member 84 for holding the members 84 and 86 in alignment.

A secondary reference member 96 extends upwardly from proximate the blade member 56 at one side of the cavity 74 for guiding the cord 14 directly above the blade member 56 at a point longitudinally displaced from the reference member 54. Thus when the cord 14 is extended from the housing 52 and held against the reference member 54, the cord 14 forms a reference portion 98 between the reference member 54 and the reference member 96, the reference portion 98 being parallel with the blade member 56 in a plane perpendicular to the bottom of the base 50.

The straightedge assembly 12 includes a hinge hook 100 fastened to an opposite side of the base 50 from the reference member 54. The hinge block 100 incorporates a second primary reference member 102 corresponding to the first primary reference member of the reference block 54. An alignment block 104, pivotably mounted to the hinge block 100 by a hinge pin 106, is selectively locked rigidly thereto in one of two positions by a thumbscrew 108. In a flush position 110, a reference surface 105 of the alignment block 104 is located not lower than the bottom of the base 50 for permitting the straightedge assembly 12 to be moved freely about on the table member 8. In a square position 112, the reference surface 105 of alignment block 104 is lowered perpendicular to both the bottom of the base 50 and the blade member 56.

With further reference to FIGS. 8–12, the arm assembly 28 comprises a clamp assembly 120 for location at an edge portion 122 of the table member 8, the table member 8 having a first side 124 for mounting a drawing sheet 126, and an opposite side 128. The clamp assembly 120 includes a frame member 130 having a nut member 132 rigidly fastened thereto by a plurality of screws 134. A clamp screw 136 threadingly engages the nut member 132, the clamp screw 136 having a shoe member 138 for bearing against the first side 124 of the table member 8. The clamp screw 136 extends through the nut member 132 to a clamp knob 140, the knob 140 being rigidly attached to the clamp screw by a lock nut 142.

The frame member 130 extends from the nut member 132 alongside the edge portion 122 to a flange portion 144 proximate the second side 128 of the table member 8. A spacer 146, retained on the flange portion 144 by a spacer screw 145 and nut 147, bears against the second side 128 of the table member 8. Thus the clamp assembly 120 clamps the table member 8 rigidly between the shoe member 138 and the spacer 146 when the clamp screw 136 is tightened by the clamp knob 140.

Figure 10:
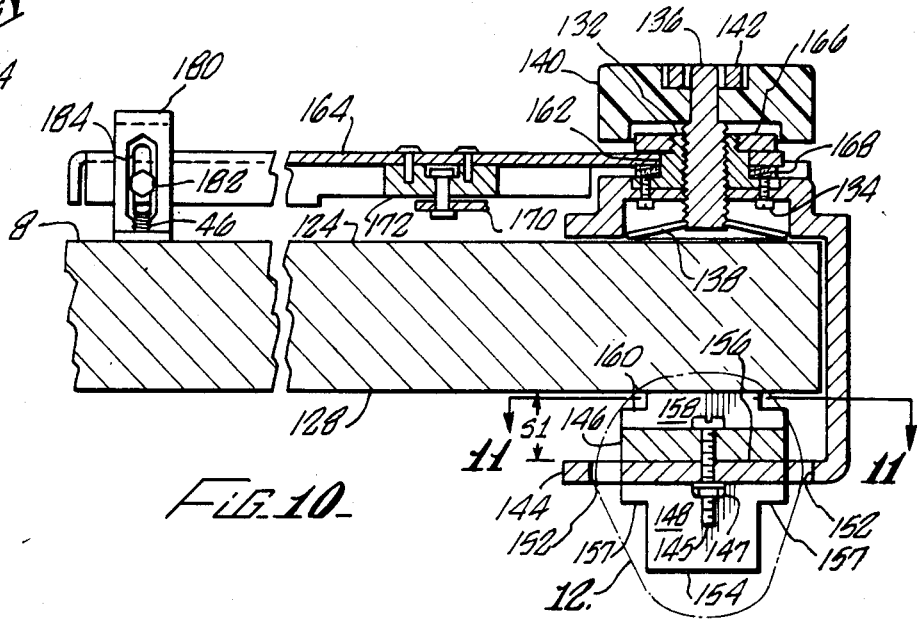
FIG. 10 is a fragmentary sectional elevational view of the apparatus of FIG. 8 along line 10—10 of FIG. 9.

The purpose of the spacer 146 is to allow the clamp knob 140 to be located conveniently above the table member 8, instead of underneath the table member 8 as is in conventional table clamps. The spacer 146 provides a selected thickness between the flange portion 144 and the second side 128 for compensating variant thicknesses of the table member 8. Thus the spacer 146 permits the nut member 132 to be clamped proximate a predetermined distance from the first side of the table member 8 for reasons described herein. The spacer 146 cooperates with the flange portion 144 to provide the selected spacing by incorporating at least one leg 148 for selectively engaging a pair of first apertures 150 and a second apertures 152 in the flange portion 144. The leg 148 has a minor cross-sectional area at a first end 154 and a major cross-sectional area at a second end 156 thereof, a step member 157 being located therebetween for stepping between the major and minor cross-sectional areas. The first aperture 150 is capable of receiving the first end 157, but not the second end 156 of the leg 148. The second aperture 152 capable of receiving the second end 156 of the leg 146. Accordingly, when the spacer 146 is assembled to the flange portion 144 with the leg 148 protruding the second aperture 152 as shown in FIG. 10, a first spacing S1 is provided between the flange portion 144 and the second side of the table member 8. When the spacer 146 is assembled with the leg 148 protruding the first aperture 150, the step member 157 bearing against the flange portion 144, a second spacing S2 is provided. Further, the spacer 146 is provided with an oppositely projecting additional leg 158 having a step member 160. When the spacer 146 is assembled with the leg 158 protruding the first aperture 150, the step member 160 bearing against the flange portion 144, a third spacing S3 is obtained. Also, when the leg 158 protrudes the second aperture 152, a fourth spacing S4 results. Thus the spacer 146 is capable of providing four discrete spacings S1–S4 between the flange portion of the frame member 130 and the second side of the table member 8. Consequently, the clamp screw 136 can be made shorter than otherwise necessary for accomodating a wide range of thicknesses of the table member 8. More importantly, the nut member 132 can be positioned close to a predetermined distance above the first side 124 of the table member 8 as described herein.

The nut member 132 incorporates a hub portion 162 for pivotably mounting an arm 164, the arm 164 supporting the threaded post 46 at the vanishing point 18'. The arm 164 is lightly clamped on the hub portion 162 between an arm nut 166 and a resilient washer 168. A slotted link 170, pivotably mounted to the arm 164 by a pivot block 172, extends to a lock post 174, fastened to the frame member 130 for locking the arm 164 in a desired angular position relative to the frame member 130. The lock post 174 and an oppositely disposed lock post 176 are threaded for engaging a lock nut 178, the link 170 and the lock nut 178 being used with a selected one of the lock posts 174 and 176, depending on the desired position of the arm 164.

The post 46 is fixed to a bracket 180, the bracket 180 being clamped on the arm 164 by a bracket screw 182. The bracket 180 incorporates a slot 184 for vertically adjusting the location of the post 46 with respect to the arm 164. Thus the post 46 can be located proximate the plane of the first side 124 of the table member 8, notwithstanding variations in the vertical position of the nut member 132 above the table member 8.

The arm assembly 28 contributes to the present invention by providing a conveniently adjustable location of the anchor means 16, both inside and outside the area of the table member 8. Because the clamp knob is located above the table member 8, the clamp assembly 120 is easily positioned and locked in a desired location along the edge portion 122 of the table member 8, without a user having to reach underneath the table member 8. Thus the post 46 can be locked at the vanishing point 18' by the steps of loosening the clamp screw 136 and the lock nut 178, sliding the clamp assembly 120 along the edge portion 122, pivoting the arm 64 for locating the post 46 at the vanishing point 18' then tightening the clamp screw 136 and the lock nut 178.

The straightedge assembly 12 is easy to use in that it requires no mechanism adjustment. It is effective in that there is not restriction to certain viewing angles or small drawings sizes. It is accurate in that alignment to the vanishing point 18' is obtained by direct observation and does not depend on a sloppy or error-prone mechanism. It is convenient to use in that it is compact, not requiring, a long, rigid structure for reaching a remotely located vanishing point.

The apparatus 10 of the present invention is portable in that it is compact and does not require any particular table structure for proper operation. It can be used in any orientation between horizontal and vertical. Also the apparatus 10 does not obstruct large portions of the drawings surface.

An important feature of the present invention is that the straightedge assembly 12 can be rapidly positioned in alignment with one or more than one of the vanishing points 18. This is particularly convenient in that separate guides are not required for each vanishing point. Thus, when it is required to draw line segments in close proximity that are aligned to separate vanishing points, only small movements of the straightedge assembly are required.

A further advantage of the present invention is that the location of the vanishing point 18 is limited only by length of the cord 14. The spool 58 is capable of holding a very long length of the cord 14 in a small space. For example, in an experimental version of the present invention having a pair of the spools 58, each of the spools 58 is capable of storing more than one meter of the cord 14, within an outside diameter of 33 mm and a width of about 8 mm, the associated spring 66 being capable of turning the spool 58 about 11 revolutions. In the experimental version, the springs 66 are confined to a diameter of 26 mm in the spools 58. It is expected that a significantly greater capacity for the cord 14 will result from enlarging the springs 66 within the same 33 mm outside diameter of the spools 58.

Although the present invention has been described in considerable detail with reference to certain preferred versions thereof, other versions are possible. For example, apparatus for storing and tensioning the flexible member 14 can be located in association with the vanishing points 18 instead of the straightedge assembly 12. The straightedge assembly 12 can be provided with reference data on the base 50 and scale indicia on the blade member 46. The lid 78 can be adapted for removably holding an electronic calculator. Also, more than two of the flexible members 14 can be included in the straightedge assembly 12. Moreover, one flexible member and associated storage, tensioning, and alignment means can be located opposite the blade member 56 in association with the blade member 57. Therefore, the spirit and scope of the appended claims should not necessarily be limited to the description of the preferred versions contained herein.

What is claimed is:

1. Apparatus for producing perspective drawings on a planar drawing surface, the apparatus comprising:

(a) a base member for positioning on the drawing surface, the base member having a straight blade member for guiding a writing device along a linear path;

(b) a flexible member attached to the base member and capable of being extended therefrom to a selected fixed position in the plane of the drawing surface, the fixed position defining a vanishing point;

(c) means for tensioning the flexible member, the flexible member forming a ray portion radiating on a straight line from the vanishing point; and (d) means for aligning the blade member with the ray portion of the flexible member, including means for determining a desired relative angular relation between the blade member and the ray portion of the flexible member wherein the linear path intersects the vanishing point as the blade member is pivoted about a reference point that is intended to be on the linear path.

2. Apparatus for producing perspective drawings on a planar drawing surface, the apparatus comprising:

(a) a base member for positioning on the drawing surface, the base member having a straight blade member for guiding a writing device along a linear path;

(b) a flexible member attached to the base member and capable of being extended therefrom;

(c) anchor means for locating the flexible member in a selected fixed position in the plane of the drawing surface, the fixed position defining a vanishing point;

(d) means for tensioning the flexible member, the flexible member forming a ray portion radiating on a straight line from the vanishing point, the tensioning means comprising storage means on the base member for receiving a first end of the flexible member and biasing means associated with the storage means for retracting the flexible member into the storage means; and (e) means for aligning the blade member with the ray portion of the flexible member.

3. The apparatus of claim 2 wherein the storage means is a spool member rotatably mounted to the base member and the biasing means is a spring for rotating the spool member, the flexible member being wound onto the spool member as the flexible member retracts into the storage means.

4. The apparatus of claim 3 wherein the spring protrudes the spool member, the flexible member being attached to one end portion of the spring.

5. The apparatus of claim 2 wherein the anchor means comprises swivel means attached to a second end of the flexible member.

6. The apparatus of claim 5 wherein the anchor means further comprises a pin member removably attached to the swivel means, the pin member and the swivel means being coaxially aligned, the pin member being adapted for penetrating the drawing surface.

7. The apparatus of claim 5 wherein the anchor means further comprises a plate member removably attached to the swivel means, the plate member having target indicia for locating the swivel means in alignment with intersecting line segments on the drawing surface, and tab means extending outwardly from the swivel means beyond the target indicia for permitting the plate member to be fastened to the drawing surface by adhesive tape means without obscuring the target indicia.

8. The apparatus of claim 5 wherein the anchor means further comprises arm means comprising:

(a) clamp means for rigidly fastening the arm means to the drawings surface;

(b) an arm member pivotably mounted to the clamp means;

(c) means for locking the arm member in a fixed angular position with respect to the clamp means; and (d) means for mounting the swivel means proximate the plane of the drawing surface in fixed relation to the arm member.

9. The apparatus of claim 8 wherein the drawing surface is fixed on a first side of a table member, the table member having an opposite side and an edge portion, the clamp means further comprising:

(a) a frame member for receiving the edge portion of the table member, the frame member including a nut member;

(b) a shoe member for bearing against the first side of the table member, the shoe member threadingly engaging the nut member; and (c) a spacer member engaging the frame member for bearing against the opposite side of the table member, the spacer member being selectively capable of bearing against the opposite side of the table member at one of at least two positions relative to the nut member, the positions including first and second distances from the nut member in a direction perpendicular to the plane of the drawing for locating the nut member proximate a predetermined distance from the first surface of the door member, wherein the means for mounting the swivel means is adjustable in the direction perpendicular to the plane of the drawing for compensating the difference between the distance of the nut member from the first surface and the predetermined distance.

10. The apparatus of claim 9 wherein:

(a) the spacer member comprises a first leg member having a first cross-section at a first end thereof, a second cross-section at a second end thereof, and a step member therebetween; and (b) the frame member has formed therein a first aperture for clearing the first cross-section and a second aperture for clearing the second cross-section, the spacer member bearing against the opposite side of the table member at the first distance when the first leg member protrudes the first aperture, the step member bearing against the frame member, and at the second distance when the first leg member protrudes the second aperture, the step member not bearing against the frame member.

11. The apparatus of claim 10 wherein the spacer member further comprises a second leg member, the second leg member bearing against the opposite side of the table member when the first leg member protrudes the frame member, the spacer member capable of engaging the frame member in an inverted position wherein the spacer member selectively bears against the opposite side of the table member at third and fourth distances from the nut member.

12. The apparatus of claim 2 wherein the means for aligning comprises:

(a) a primary reference member extending upwardly from the base member proximate a first end of the blade member; and (b) a secondary reference member extending upwardly from the base member proximate the blade member and spaced remotely from the primary reference member, whereby, when the flexible member contacts the primary reference member, the flexible member forms a reference portion between the primary reference member and the secondary reference member, the reference portion being parallel to the blade member in a plane perpendicular to the drawing surface.

13. The apparatus of claim 2 further comprising at least two of the flexible members, each flexible member cooperating with corresponding anchor means, tensioning means, and aligning means, wherein the blade member is capable of being selectively aligned to one or the other of the ray portions of the respective flexible members.

14. Apparatus for producing perspective drawings on a planar drawing surface, the apparatus comprising:

(a) a base member for positioning on the drawing surface, the base member having a straight blade member for guiding a writing device along a linear path;

(b) a flexible member attached to the base member and capable of being extended therefrom;

(c) anchor means for locating the flexible member in a selected fixed position in the plane of the drawing surface, the fixed position defining a vanishing point;

(d) means for tensioning the flexible member, the flexible member forming a ray portion radiating on a straight line from the vanishing point;

(e) means for aligning the blade member with the ray portion of the flexible member; and (f) a hinge member on the base member, the hinge member having a reference surface, the hinge member having a first position wherein the reference surface is not below the plane of the drawing and a second position wherein the reference surface is locked perpendicular to both the plane of the drawing and a plane of the blade member orthogonal to the plane of the drawing.

15. Apparatus for producing perspective drawings on a planar drawing surface, the apparatus comprising:

(a) a base member for positioning on the drawing surface, the base member having a straight blade member for guiding a writing device along a linear path;

(b) at least two flexible members attached to the base member and capable of being independently extended therefrom;

(c) anchor means for locating each flexible member in a selected fixed position in the plane of the drawing surface, each fixed position defining a corresponding vanishing point;

(d) means for tensioning each flexible member, the flexible members each forming a ray portion radiating on a straight line from the corresponding vanishing point, each tensioning means comprising:

(i) a spool member rotatably mounted to the base member for receiving a first end of the flexible member; and (ii) biasing means associated with the storage means for retracting the flexible member onto the spool member; and (e) means for selectively aligning the blade member with the ray portion of the respective flexible members, the means for aligning comprising:

(i) a primary reference member for each flexible member, each primary reference member extending upwardly from the base member proximate an end of the blade member;

(ii) a secondary reference member for each flexible member, each secondary reference member extending upwardly from the base member proximate the blade member and spaced remotely from the respective primary reference member, whereby, when each flexible member contacts the corresponding primary reference member, that flexible member forms a corresponding reference portion between the respective primary reference member and the associated secondary reference member, the reference portion being parallel to the guide member in a plane perpendicular to the drawing surface.

16. The apparatus of claim 15 wherein the drawing surface is fixed on a first side of a table member, the table member having an opposite side and an edge portion, at least one of the the anchor means further comprising arm means comprising:

(a) clamp means for rigidly fastening the arm means to the drawing surface, the clamp means further comprising:

(i) a frame member for receiving the edge portion of the table member, the frame member including a nut member;

(ii) a shoe member for bearing against the first side of the table member, the shoe member threadingly engaging the nut member; and (iii) a spacer member engaging the frame member for bearing against the opposite side of the table member, the spacer member being selectively capable of bearing against the opposite side of the table member at one of at least two positions relative to the nut member in a direction perpendicular to the plane of the drawing for locating the nut member proximate a predetermined distance from the first surface of the table member;

(b) an arm member pivotably mounted to the clamp means;

(c) means for locking the arm member in a fixed angular position with respect to the clamp means; and (d) means for mounting the swivel means proximate the plane of the drawing surface in fixed relation to the arm member, the means for mounting being adjustable in the direction perpendicular to the plane of the drawing for compensating the difference between the distance of the nut member from the first surface and the predetermined distance.

17. A method for producing a perspective drawing on a planar drawing surface, the drawing having line elements converging at a first vanishing point, the method comprising the steps of:

(a) locating first anchor means at the first vanishing point;

(b) connecting a first flexible member at a first end thereof to the first anchor means;

(c) connecting a second end of the first flexible member to a first tensioning spool, the first tensioning spool being mounted to a straightedge, the first flexible member forming a first ray portion radiating on a straight line from the first vanishing point;

(d) positioning the straightedge on the drawing surface so that the first ray portion points along a selected one of the line elements; and (e) aligning the straightedge with the first ray portion of the first flexible member.

18. The method of claim 16 in which the drawing also has a second vanishing point, the method further comprising the steps of:

(a) locating second anchor means at the second vanishing point;

(b) connecting a second flexible member at a first end thereof to the second anchor means;

(c) connecting a second end of the second flexible member to a second tensioning spool, the second tensioning spool being mounted to a straightedge, the second flexible member forming a second ray portion radiating on a straight line from the second vanishing point;

(d) positioning the straightedge on the drawing surface so that the second ray portion points along a selected one of the line elements; and (e) aligning the straightedge with the second ray portion of the second flexible member.

19. The apparatus of claim 1 further comprising anchor means for locating the fixed position of the flexible member.

20. The apparatus of claim 1 wherein the means for aligning comprises:

(a) a primary reference member extending upwardly from the base member proximate a first end of the blade member; and (b) a secondary reference member extending upwardly from the base member proximate the blade member and spaced remotely from the primary reference member, whereby, when the flexible member contacts the primary reference member, the flexible member forms a reference portion between the primary reference member and the secondary reference member, the reference portion being parallel to the blade member in a plane perpendicular to the drawing surface.

21. The apparatus of claim 1 further comprising at least two of the flexible members, each flexible member cooperating with corresponding anchor means, tensioning means, and aligning means, wherein the blade member is capable of being selectively aligned to one or the other of the ray portions of the respective flexible members.

22. The apparatus of claim 1 wherein the drawing surface is fixed on a first side of a table member, the table member having an opposite side and an edge portion, at least one of the the anchor means further comprising arm means comprising:

(a) clamp means for rigidly fastening the arm means to the drawing surface at a desired location along the edge portion of the table member;

(b) an arm member pivotally mounted to the clamp means;

(c) means for locking the arm member in a fixed angular position with respect to the clamp means; and (d) means for attaching the flexible member proximate the plane of the drawing surface at a point located in fixed relation to the arm member, whereby the point of attachment can be located at the vanishing point proximate the plane of the table member, selectively both within and without a region bounded by the edge portion, by adjusting the location of the clamp means along the edge portion and the angular position of the arm member with respect to the clamp means.

23. The apparatus of claim 22 wherein the clamp means further comprises:

(a) a frame member for receiving the edge portion of the table member, the frame member including a nut member;

(b) a shoe member for bearing against the first side of the table member, the shoe member threadingly engaging the nut member; and (c) a spacer member engaging the frame member for bearing against the opposite side of the table member, the spacer member being selectively capable of bearing against the opposite side of the table member at one of at least two positions relative to the nut member in a direction perpendicular to the plane of the drawing for locating the nut member proximate a predeterminded distance from the first surface of the table member.

24. The apparatus of claim 22 wherein the arm member is capable of being located by the clamp means at variable spacing from the first side of the table member, and the means for attaching is adjustable in the direction perpendicular to the plane of the drawing for compensating the spacing of the are member from the first side of the table member.

* * * * *